United States Patent [19]

Judd

[11] 4,309,887

[45] Jan. 12, 1982

[54] PRODUCTION OF COPPER TUBING

[75] Inventor: Douglas K. Judd, Penrith, Australia

[73] Assignee: Crane Enfield Metals Pty. Limited, Australia

[21] Appl. No.: 63,987

[22] Filed: Aug. 6, 1979

[30] Foreign Application Priority Data

Aug. 7, 1978 [AU] Australia ..... PD5399

[51] Int. Cl.[3] ..... B21C 1/00; B21C 47/26

[52] U.S. Cl. ..... 72/280; 226/118; 242/78

[58] Field of Search ..... 228/156, 158, 147, 5.1, 228/18, 47; 29/DIG. 11; 72/280, 283; 242/54 R, 78, 80, 82; 226/118, 119; 266/102–104

[56] References Cited

U.S. PATENT DOCUMENTS

| | | | |
|---|---|---|---|
| 353,578 | 11/1886 | McKinny | 242/80 |
| 1,772,948 | 8/1930 | Honig | 72/280 |
| 2,448,835 | 9/1948 | Schefe | 266/102 |
| 2,792,206 | 5/1957 | Wagner | 266/103 |
| 3,708,354 | 1/1973 | Rowell | 219/8.5 X |
| 3,765,215 | 10/1973 | Martin | 72/283 |

*Primary Examiner*—Gil. Weidenfeld
*Assistant Examiner*—K. J. Ramsey
*Attorney, Agent, or Firm*—Steinberg & Raskin

[57] ABSTRACT

Apparatus for the continuous production of half hard copper tubing wherein the copper tubing is fed from a roll to a tube storage means in which a continuous length of tube is stored in one or more lengths in such a manner that the front end of the tube can be drawn rapidly from the storage means while the tail end of the tube remains stationary, a movement of the tail end of the tube is arrested, the front end of a further coil of tubing is joined to the stationary tail end of the tube in the storage means as the front end of that tube is fed forward, and the movement of the tail end of the tube restarted. The above operation is carried out while feeding tubing from the storage means continuously and sequentially through an induction annealing furnace, through quenching means and thereafter to a draw finishing or coiling line.

4 Claims, 3 Drawing Figures

PRODUCTION OF COPPER TUBING

Figure 1:
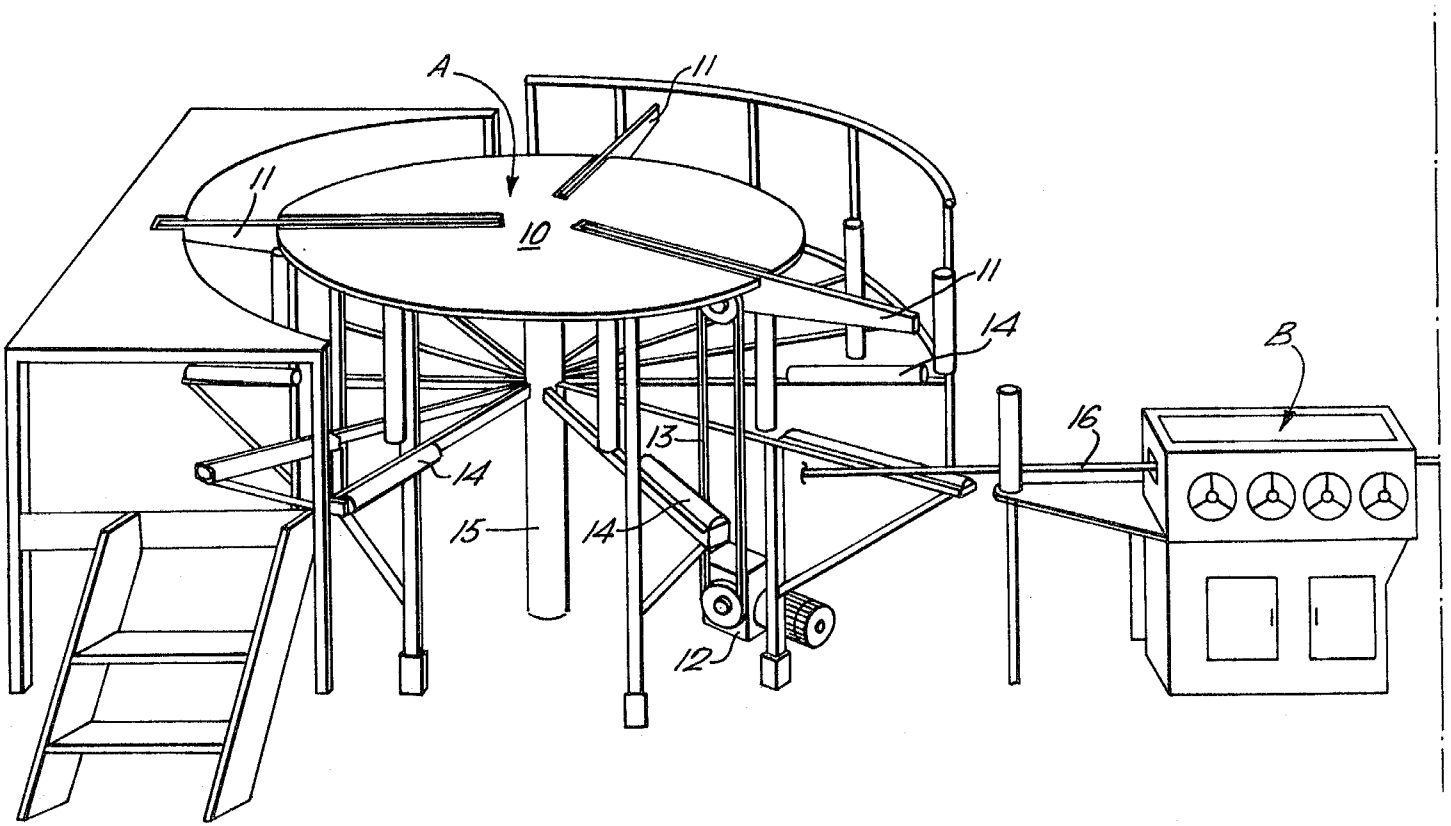

The present invention relates to the production of copper tubing and more particularly to the production of copper tubing in various tempers. The term "copper tubing" is to be read as including copper alloy tubing.

Copper tubing is generally produced and sold in the following tempers:

| | | | |
|---|---|---|---|
| 1. | HARD DRAWN | Min Tensile<br>Min Hardness | 380 N/MM$^2$<br>90 MV5 |

This tubing is usually extruded and drawn to finished size and sold at this temper.

| | | | |
|---|---|---|---|
| 2. | FULL ANNEALED | Min Tensile<br>Max Hardness | 210 N/MM$^2$<br>70 MV5 |

This tubing is produced as above but is fully annealed in conventional bell or roller hearth furnaces after the final cold draw pass.

| | | | |
|---|---|---|---|
| 3. | HALF HARD | Min Tensile<br>Hardness range | 250 N/MM$^2$<br>80–100 HV5 |

This tubing is produced as hard drawn to the penultimate draw pass. The product is then fully annealed in a bell or roller hearth furnace and finally given a light draw to finished size.

With the use of modern bullblocks of large diameter and combined drawing and finishing lines the production of hard drawn tubing is most efficient with a minimum labour requirement. The production of half hard fully annealed or temper drawn tubing by the above method however necessitates the removal of the product from the normal production line for annealing prior to the final draw pass.

Because of the large diameter and weight of the coils of tubing from bullblocks averaging (200 kgs.×2400 mm dia.) annealing by conventional methods introduces some difficult handling problems and usually requires recoiling to smaller diameters and parcel weights to ease this problem. The present invention was developed to eliminate the above problems and to provide an annealing operation which is carried out in line with conventional drawing and finishing equipment. The process of the present invention offers the following advantages to companies producing half hard tubing:

1. Savings in labour and work in progress by eliminating some of the handling and storage of tubing generally associated with the batch annealing process.
2. Increased yield due to larger parcel weights and elimination of damage in handling soft tubing.
3. Increased output due to the continuous operation made possible by joining coils end to end without stopping the line.
4. Savings in floor space due to the smaller dimensions of the annealing equipment.
5. Consistent temper of tubing obtained with infinite temperature control available.
6. Savings in power and gas requirements due to the reduction in use of protective atmospheres required in conventional furnaces.

7. Instantaneous startup and shutdown of the production unit with no heat-up or cool down periods required.
8. Temperature changes may be made with immediate reponse.

The present invention consists in a method for the continuous production of half hard copper tubing consisting of the steps of feeding drawn copper tubing from a roll thereof to a tube storage means in which a continuous length of tube is stored in one or more loops in such a manner that the front end of the tube can be drawn rapidly from the storage means while the tail end of the tube remains stationary, arresting movement of the tail end of the tube, joining the front end of a further coil of tubing to the stationary tail end of the tube in the storage means as the front end of that tube is fed forward and restarting movement of the tail end of the tube, the foregoing steps being carried out while feeding tubing from the storage means continuously and sequentially through an induction annealing furnace, through quenching means and thereafter to a draw finishing or coiling line.

The invention consists in apparatus for carrying out the method defined above.

Figure 2:
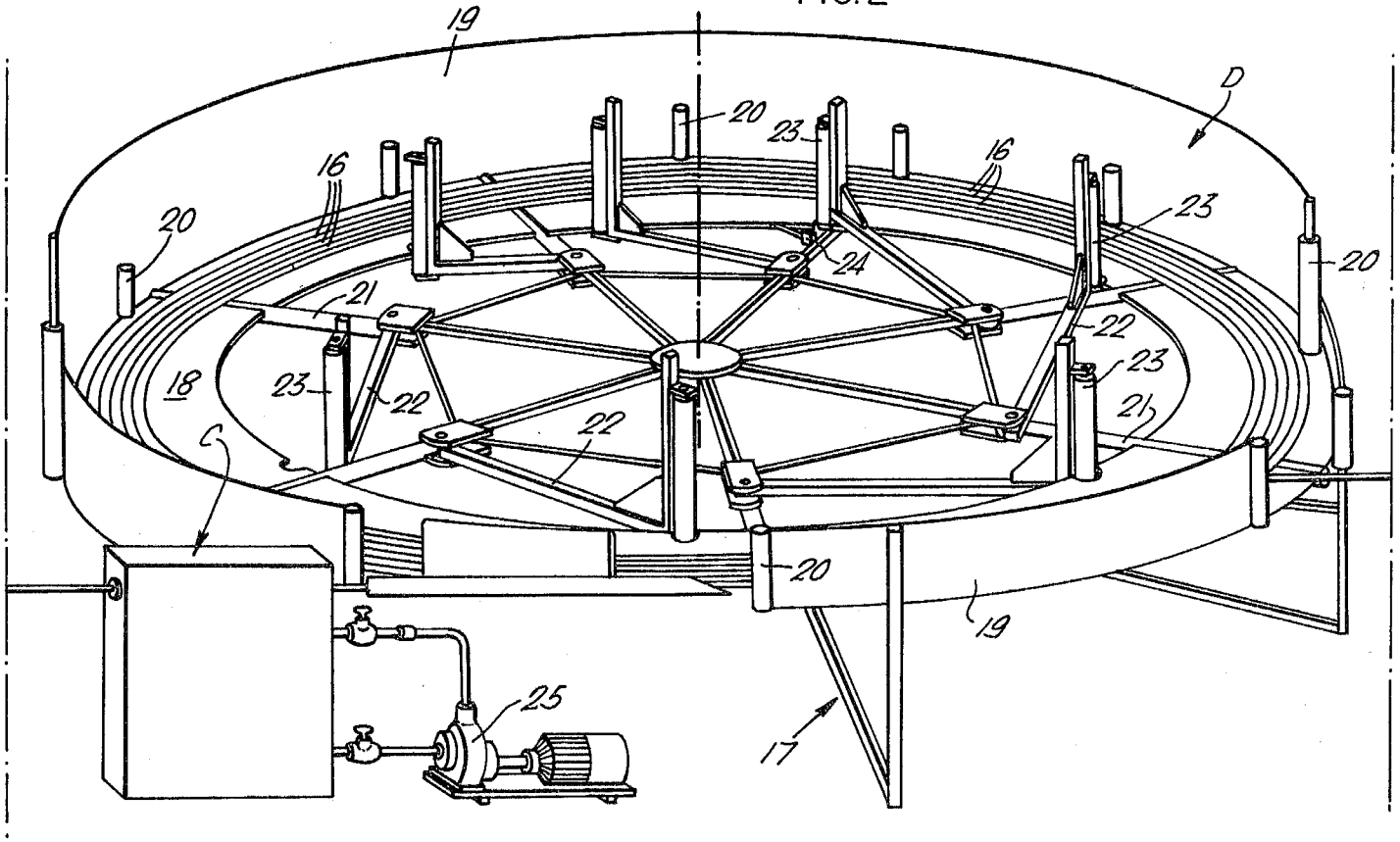
Figure 3:
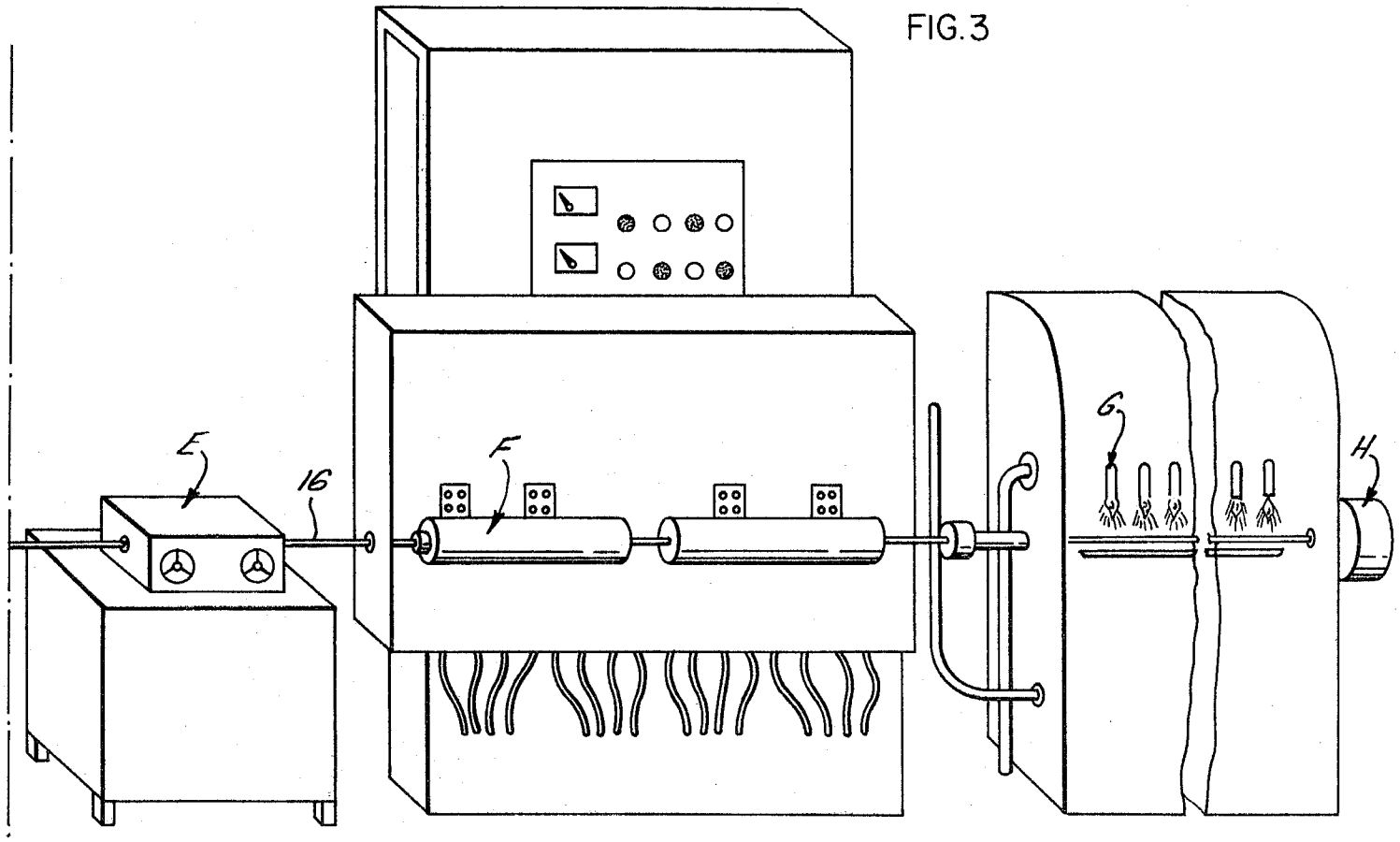

In order that the invention may be better understood and put into practice a preferred form thereof is illustrated in the accompanying drawing including FIGS. 1–3 which together show a diagrammatic view of an apparatus by means of which the method according to the invention may be carried out.

A coil of drawn copper tubing is taken directly from the bullblock at the penultimate drawing pass (not shown) and placed on a two station payoff or swift A, the swift A consists of a table 10 having set into it three arms 11 pivoted about horizontal axes at pivot points close to the periphery of the table 10. The arms 11 may either be set in the horizontal position shown or may be pivoted about a horizontal axis to take up a vertical position, the lower ends of the arms moving downwardly. Movement is effected by three electric motors one of which is indicated at 12 which drive the arm through a belt drive such as 13.

At a lower level than the table 10 are a series of rollers such as 14 arranged on radial arms which extend from a central support 15.

When a coil of drawn copper tubing is placed on the swift A it rests initially on the arms 11. If the arms are then pivoted into a vertical position the coil drops on to the rollers 14 and is supported at the lower level. The arms 11 are arranged to continue rotating until they have rotated through 180° to take up the configuration shown in the drawings in preparation for the receipt of a further coil of tubing.

In normal operation there would be a coil of tubing resting on the arms 11 and a second coil of tubing resting on the rollers 14 below the first, the forward end of the second coil being joined to the rear end of the length of tubing 16 shown passing through the apparatus. However for the sake of clarity the two coils on the swift A have been omitted.

At the commencement of operations a coil of tubing is supported on the arms 11 and a second coil is supported on the rollers 14. An operator takes the leading end of the latter coil and reduces the diameter for about 150 mm of its length on a rotary swager or push pointer, the leading end of the tubing is then fed into a roller straightener B which serves to straighten and drive the tubing through a degreasing tank C with which is associated a rotor driven pump 25, to remove any residual drawing oil and then into an accumulator D which serves as a storage device for several wraps or approximately 150 ft. of tubing.

The tubing is then fed into a smaller roller traction device E which serves to push the tubing through the induction heating coils F through the water quench tank G and then to the drawing die of a combined draw-finishing line H which may be a Lomatic Line, however, any other line of this type such as made by Schumag could be used.

The operator then starts the draw-finishing line at which time the power is applied to the induction heating coils F and the tubing is drawn in the normal manner.

The design of the induction heating coils F and of the water quench tank G is such that during its passage through the induction heating coils F at a speed of about 200 ft. per minute the temperature of the tubing is raised to a temperature of, for example, 475° C.–500° C., and is thereafter rapidly cooled to ambient temperature in the quench tank G through which the tube passes at the same speed.

As the combined draw-finishing line H is of a conventional nature it is not necessary to describe it in this specification. The finished tube after passing through the draw-finishing line H is cut to desired lengths, usually about 20 ft., and preferably means are provided for detecting joints in the tube and for cutting out lengths of tube containing a joint. It is to be noted that the whole operation is carried out continuously, in line and at high speed.

Whilst the first coil of tubing is being drawn the operator proceeds to prepare the next coil on the upper level of the swift A by pointing or reducing the diameter of the leading end so that it will slide neatly into the rear of the tubing being drawn. When the tail end of the coil being drawn comes clear of the swift, the roller straightener B is stopped and the prepointed leading end of the next coil supported on the arm 11 of the swift A is inserted into the tail end of the stationary coil end and mechanically joined. The insertion of the leading end of the next coil into the stationary tail end of the coil being treated can be accomplished while the arms 11 are being rotated to transfer the coil to the rollers 14.

While this operation is taking place the annealing and drawing operation continues using tube from the storage accumulator D. The accumulator D consists of a supporting base indicated generally at 17. This supports an annular shelf 18 having around the major part of its circumference curved shields 19 with which are associated a series of ten vertical rollers 20. Radially extending horizontal rollers 21, of which there are seven, traverse the shelf 18 and project slightly above it so that the coiled tube 16 is actually supported on the rollers 21. In the centre of the accumulator D is a system of seven swing arms 22 to which are pivotably attached a series of vertical rollers 23 which are spring urged to a radially outward position.

The purpose of the accumulator D is to store a coil of tubing in such a manner that while the trailing end of the tubing to the left of the roller straightener B is stopped, the tubing can continue to be drawn from the accumulator by means of the roller traction device E. This is possible because as tubing is drawn out of the accumulator the radius of the coils of tubing stored in it decrease causing the rollers 23 and their associated arms to swing inwardly. The storage capacity of the accumulator is such that there is sufficient tubing available to be drawn off while the tail end of the tubing 16 is stationary to enable the next coil to be joined to the tail end of the tubing, at which time the roller straightener B is restarted. In order to effect replenishment of the accumulator a position sensing device 24 is associated with one of the vertical rollers 23 and is electrically connected to the roller straightener B so that after the rollers 23 have reached an inner-most position the roller straightener B is caused to run at a greater than normal speed for a time sufficient to replenish the store of tubing in the accumulator. This occurs by reason of the fact that the rate at which tubing is fed into the accumulator under these circumstances exceeds the rate at which it is being drawn out by the roller traction device E.

At the completion of joining the leading end of the new coil to the stationary end of the coil in the accumulator which takes approximately 10 seconds, the roller straightener is restarted at a speed above that of the line as described above and quickly refills the accumulator at which time it returns to the normal line speed of 200 FPM until the completion of the coil when the above process is repeated. The mechanical joint serves only as a coupling means and is cut out and discarded automatically by an eddy current flaw detection device fitted to the combined draw finishing line.

To ensure that no oxidation takes place either internally or externally a protective atmosphere may be used at the annealing station, however, the product can be produced without the use of such protection. In the design of the equipment it is necessary to ensure that the tubing whilst at a high temperature is not subjected to either excessive tension or compression and the design of the storage or accumulator device D is such as to avoid this possibility.

The maximum power input rating of the induction heater is 400 KVA however, for normal operating conditions on tubing up to 22 mm OD normal power requirements are about 75% of that figure. However, power may be varied to suit other speeds and tube sizes as required.

After the initial thread up the line can operate on a continuous basis allowing substantial productivity improvements over the conventional operation of a combined drawing and cut to length line.

I claim:

1. Apparatus for the continuous production of half hard copper tubing, comprising coil supporting means for supporting a first coil of copper tubing and a second coil of copper tubing including means for transferring the second coil to the position previously occupied by the first upon said first coil being drawn off, coil accumulator means for intermittently accumulating tubing in coiled form while providing a continuous supply of stored tubing, tube treatment apparatus including annealing means and quenching means, first means for drawing off said first coil of tubing and transferring the same to said coil accumulator means, second means for continuously drawing off tubing from said coil accumulator means and feeding the same to said annealing means, and thence to said quenching means, and means for stopping and starting said first drawing off means.

2. Apparatus as claimed in claim 1 including means for controlling the rate at which said first drawing off means draws off said first coil of tubing whereby said rate can be increased to replenish said coil accumulator means.

3. Apparatus as claimed in claim 1 or claim 2 wherein said coil accumulator means includes a plurality of radially extending horizontal rollers arranged to support between them a coil of tubing, a plurality of vertically extending rollers each mounted on means acting to urge said vertically extending rollers outwardly against said coil of tubing while permitting them to move inwardly as the diameter of said coil of tubing is contracted by tubing being drawn off from said coil accumulator means faster than it is transferred to it.

4. Apparatus as claimed in claim 1 wherein said annealing means comprise an induction annealing furnace and said tube treatment apparatus further includes a draw finishing line.

* * * * *